US010487515B2

(12) United States Patent
Steffes et al.

(10) Patent No.: US 10,487,515 B2
(45) **Date of Patent: *Nov. 26, 2019**

(54) PANEL SIDING PRODUCT

(71) Applicant: CERTAINTEED CORPORATION, Malvern, PA (US)

(72) Inventors: Stephen W. Steffes, McPherson, KS (US); Robert D. Shaw, Parma, MI (US); Brian W. Kirn, Hatboro, PA (US); David J. Stucky, Grass Lake, MI (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/270,869

(22) Filed: Feb. 8, 2019

(65) Prior Publication Data

US 2019/0169857 A1 Jun. 6, 2019

Related U.S. Application Data

(63) Continuation of application No. 15/849,907, filed on Dec. 21, 2017, now Pat. No. 10,221,575, which is a continuation of application No. 15/340,237, filed on Nov. 1, 2016, now Pat. No. 9,885,185, which is a continuation of application No. 14/568,429, filed on Dec. 12, 2014, now Pat. No. 9,482,011.

(60) Provisional application No. 61/917,398, filed on Dec. 18, 2013.

(51) Int. Cl.
*E04F 13/08* (2006.01)
*E04F 13/073* (2006.01)

(52) U.S. Cl.
CPC ..... *E04F 13/0864* (2013.01); *E04F 13/0733* (2013.01); *E04F 13/0871* (2013.01)

(58) Field of Classification Search
CPC .... E04F 13/26; E04F 13/0864; E04F 13/0871
See application file for complete search history.

(56) References Cited

U.S. PATENT DOCUMENTS

| | | | | |
|---|---|---|---|---|
| 4,930,287 A * | 6/1990 | Volk | E04F 13/0864 264/145 |
| 5,150,555 A * | 9/1992 | Wood | E04F 13/0864 52/544 |
| 7,207,145 B2 * | 4/2007 | Stucky | E04F 13/0864 52/520 |

* cited by examiner

*Primary Examiner* — Patrick J Maestri
(74) *Attorney, Agent, or Firm* — Abel Schillinger, LLP; Thomas H. Osborn

(57) ABSTRACT

A siding product is disclosed and includes a panel comprising a front with a simulated wood grain, a hollow back opposite the front, a longitudinal length extending in an x-direction, a lateral width extending in a y-direction, and a transverse depth extending in a z-direction. The panel includes a hanger clip on the front that has a hanger clip length that extends longitudinally in the x-direction, the hanger clip length is at least about 50% of the longitudinal length of the panel, and a butt leg on the hollow back. Moreover, the butt leg of the panel is configured to engage the hanger clip of a lower panel without interlocking, such that they do not engage each other with positive snap action engagement.

19 Claims, 7 Drawing Sheets

PANEL SIDING PRODUCT

CROSS-REFERENCE TO RELATED APPLICATION(S)

This application is a continuation of and claims priority to U.S. patent application Ser. No. 15/849,907, entitled "PANEL SIDING PRODUCT", by Stephen W. STEFFES et al., filed Dec. 21, 2017, which application is a continuation of and claims priority to U.S. patent application Ser. No. 15/340,237, entitled "PANEL SIDING PRODUCT", by Stephen W. STEFFES et al., filed Nov. 1, 2016, now U.S. Pat. No. 9,885,185, which application is a continuation of and claims priority to U.S. patent application Ser. No. 14/568,429, entitled "PANEL SIDING PRODUCT", by Stephen W. STEFFES et al., filed Dec. 12, 2014, now U.S. Pat. No. 9,482,011, which application claims priority under 35 U.S.C. § 119(e) to U.S. Patent Application No. 61/917,398, entitled "PANEL SIDING PRODUCT", by Stephen W. STEFFES et al., filed Dec. 18, 2013, of which all applications are assigned to the current assignee hereof and incorporated herein by reference in their entireties.

BACKGROUND OF THE INVENTION

Field of the Disclosure

The present invention relates in general to building products and, in particular, to a panelized siding product.

Description of the Related Art

Natural material such as wood shake is used as a building product to cover a substrate of a building, such as a wall. The wood shake provides the function of covering and protecting the wall of the building. In addition, the wood shake has an aesthetically appealing appearance.

Wood shake is traditionally formed from wood such as cedar. Wood shake is relatively expensive to produce because it requires harvesting and splitting of wood, which is time consuming, labor intensive, and results in excess unused wood that is not suitable for shake.

In addition, wood shake is relatively expensive and labor intensive to install. Several individual pieces of wood shake are first mounted to the substrate in a row. Care is taken to space each of the wood shake from each to accommodate for expansion and retraction of the wood shake due to atmospheric changes. A layer of felt is then mounted to the substrate overlapping a portion of the row of wood shake. Then a second row of wood shake is mounted to the substrate overlapping the felt such that the felt interleaves the two rows of shake. This configuration is repeated such that several rows of wood shake interleaved with felt cover the substrate.

With wood shake, the interleaved felt is intended to prevent wind and blowing precipitation from blowing between adjacent pieces of wood shake and below overlapping pieces of wood shake. As such, the felt reduces water logging of the wood shake and water intrusion to the substrate and acts as an insulator. However, as stated above, the material and installation associated with the interleaved felt is relatively expensive and labor intensive.

In addition, attempts to produce polymeric building products to have an appearance that simulates the look of natural material have had limited success. In particular, improvements in the texture and color of the polymeric building product continue to be of interest. Accordingly, improvements in building products that simulate natural materials continue to be of interest.

SUMMARY

Embodiments of a panelized siding product are disclosed. The siding product may include a panel having a plurality of simulated courses of simulated shingles including a front, back, top, bottom and sides. A hanger clip extends forward and downward from adjacent the top of the panel. The hanger clip comprises a single hanger clip that extends continuously substantially from side to side of the panel. A butt leg extends rearward and upward from adjacent the bottom of the panel. The butt leg of an upper panel is configured to engage the hanger clip of a lower panel in two courses of panels. The hanger clip of the lower panel and the butt leg of the panel directly engage each other without the need of an additional component.

In another embodiment of a siding product, a panel having a plurality of simulated courses of simulated shingles includes a front, back, top, bottom and sides. A hanger clip extends from the front of the panel. A butt leg extends from the back of the panel and is configured to engage the hanger clip of a lower panel in two courses of panels. A plurality of hammer positioning pads (HPP) extend from the panel and are spaced apart from the hanger clip. Versions of the HPP do not contact the hanger clip. The HPP are configured to be impacted by a hammer to adjust a position of the panel on a structure from side to side.

In still another embodiment, a siding product may comprise a panel having a front with a simulated wood grain, a hollow back opposite the front, a longitudinal length extending in an x-direction, a lateral width extending in a y-direction, and a transverse depth extending in a z-direction. The panel can have a hanger clip on the front that has a hanger clip length that extends longitudinally in the x-direction. The hanger clip length is at least about 50% of the longitudinal length of the panel. A butt leg is located on the hollow back. The butt leg of the panel may be configured to engage the hanger clip of a lower panel without interlocking, such that they do not engage each other with positive snap action engagement.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments as understood by those of ordinary skill in the art.

The use of the same reference symbols in different drawings indicates similar or identical items.

DETAILED DESCRIPTION

Figure 1:
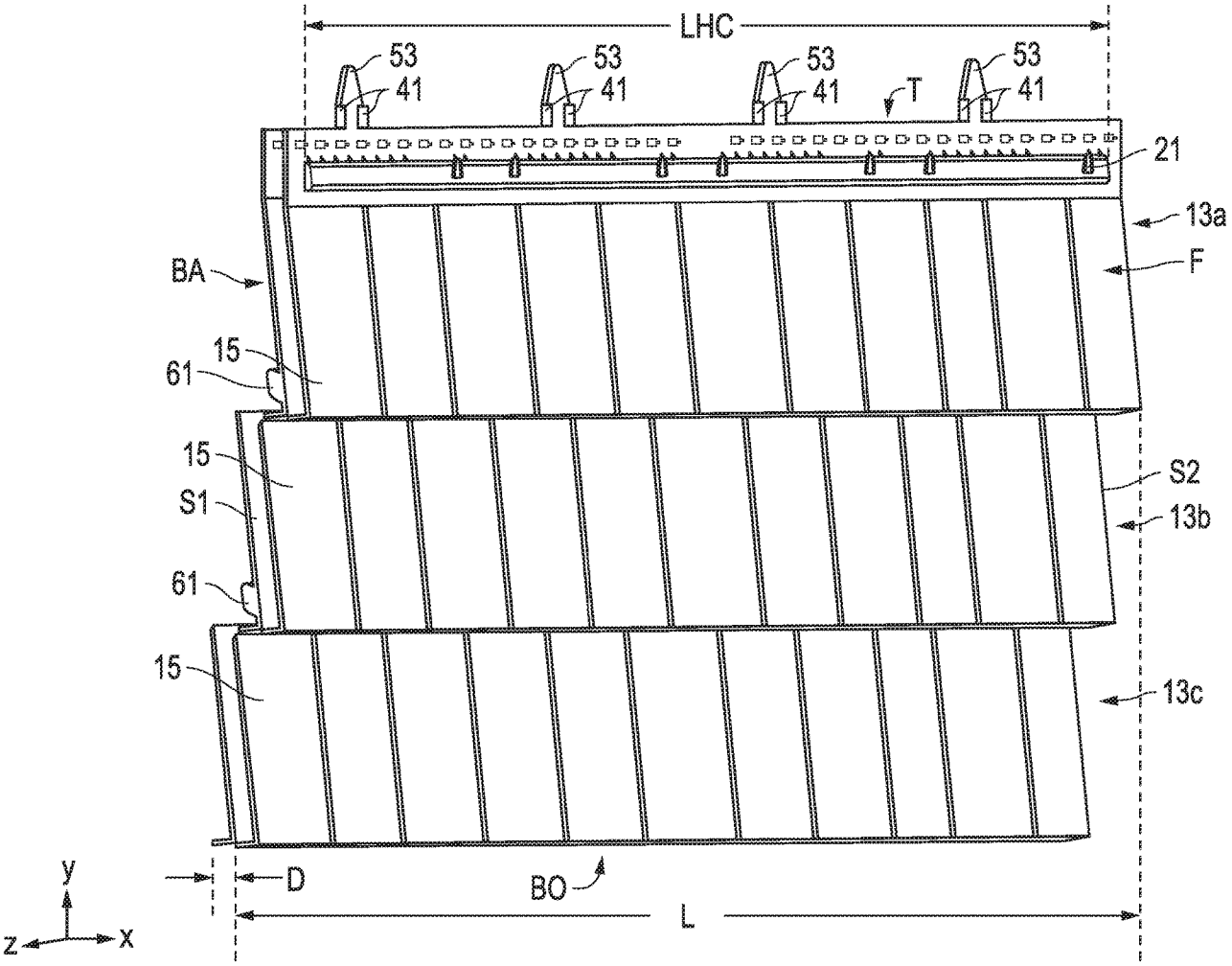
FIG. 1 is a front isometric view of an embodiment of siding product.

Embodiments of a system, method and apparatus for a siding product are disclosed. The siding product is not a roofing product, nor does it comply with roofing product standards. As shown in FIG. 1, the siding product may include a panel 11. The panel comprise a variety of materials, such as a rigid polymer material. The panel 11 may include a front F, a back BA, a top T, a bottom BO and two sides S1, S2. Embodiments of the front F of the panel 11 may include a simulated pattern. For example, the front F may include a simulated wood grain or simulated slate. In a version, the back BA may be configured as a hollow back configuration.

Embodiments of the panel may include a plurality of simulated courses 13 (e.g., three horizontal courses 13*a*, 13*b*, 13*c* are shown). Each course 13 may include a plurality of simulated shingles 15 (e.g., eleven shingles in each course 13). The panel 11 can have a nominal wall thickness of not greater than about 0.110 inches, such as not greater than about 0.100 inches, or even not greater than about 0.090 inches. The nominal wall thickness can be at least about 0.070 inches, such as at least about 0.080 inches. The nominal wall thickness can be in a range between any of these values.

Figure 2:
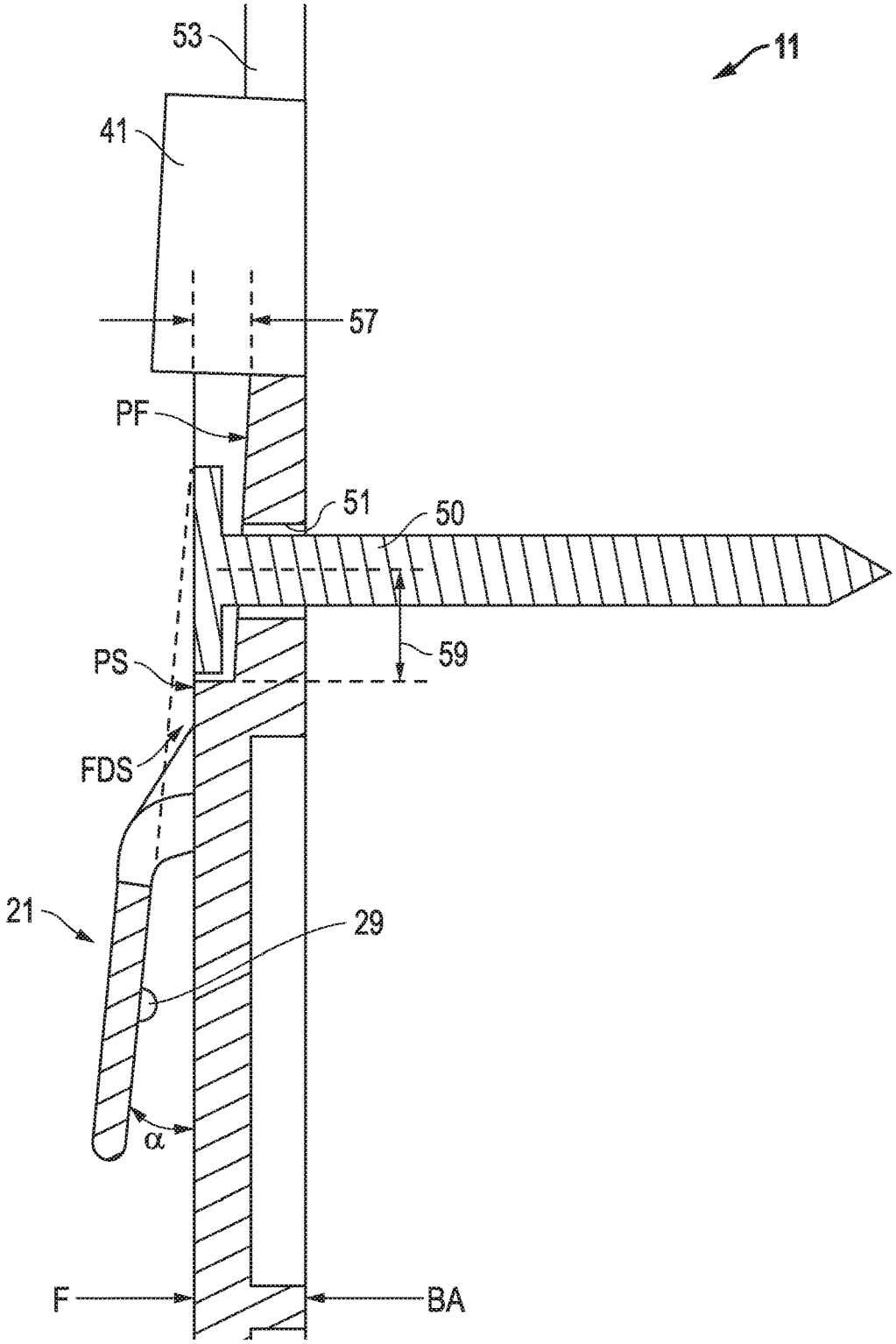
FIG. 2 is an enlarged sectional side view of an upper portion of an embodiment of a siding product.
Figure 3:
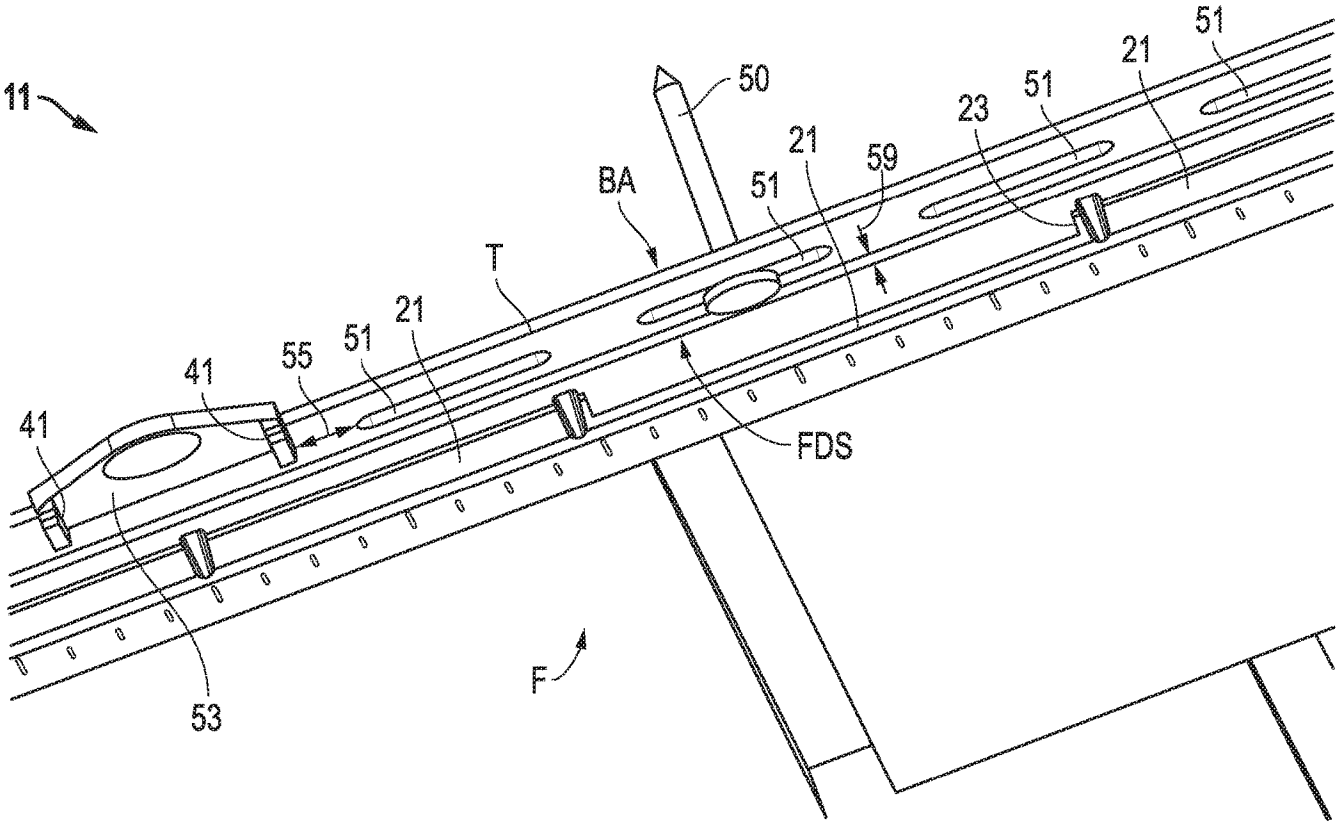
FIG. 3 is an enlarged top-front isometric view of an upper portion of an embodiment of a siding product.

In some embodiments, a hanger clip 21 extends from the panel 11. As shown in FIGS. 2 and 3, the hanger clip 21 may be located adjacent the top T of the panel 11. The hanger clip 21 may extend as a forward extension 25 from the front F, and as a downward extension 27 from the forward extension 25. Such a configuration of hanger clip 21 may comprise a female receptacle. The downward extension 27 may form an angle $\alpha$ relative to the front F of the panel 21. For example, angle $\alpha$ may be less than about 10 degrees or, in another embodiment, not greater than about 5 degrees.

Embodiments of the hanger clip 21 may comprise a single hanger clip, rather than a plurality of discrete hanger clips as in is known in the art. The hanger clip 21 can extend continuously across panel 11, and substantially from side S1 to side S2 of the panel 11. The hanger clip 21 may be considered 'continuous' since it may consist of a single integrated clip, rather than a plurality of 'discontinuous' (i.e., detached and spaced-apart) hanger clips as is known in the art. The hanger clip 21 may be provided with apertures 23 (FIG. 3) therein.

Embodiments of the panel 11 may include a longitudinal length L (FIG. 1) extending in an x-direction (see, e.g., Cartesian coordinate system x-y-z). The panel 11 may further include a lateral width W extending in a y-direction, and a transverse depth D extending in a z-direction. Versions of the hanger clip 21 may include a hanger clip length LHC that extends longitudinally in the x-direction. In an embodiment, the hanger clip length LHC can be at least about 50% of the longitudinal length L of the panel 21. In other embodiments, the LHC can be at least about 60%, at least about 70%, at least about 80%, at least about 90%, or even at least about 95% of the longitudinal length L of the panel 21. The LHC can be in a range between any of these values.

Figure 4:
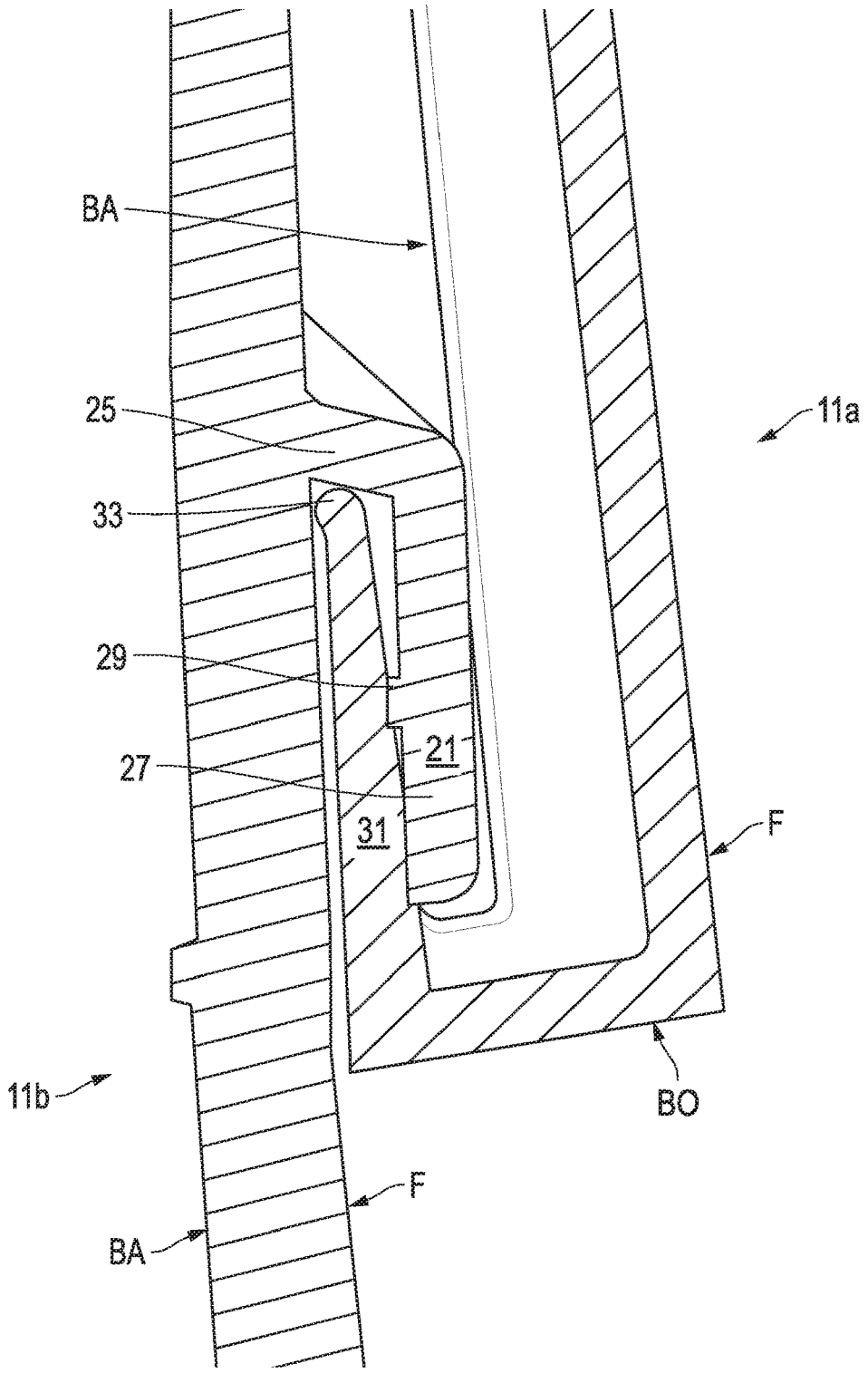
FIG. 4 is an enlarged side view of an engagement between an embodiment of two siding products.
Figure 5:
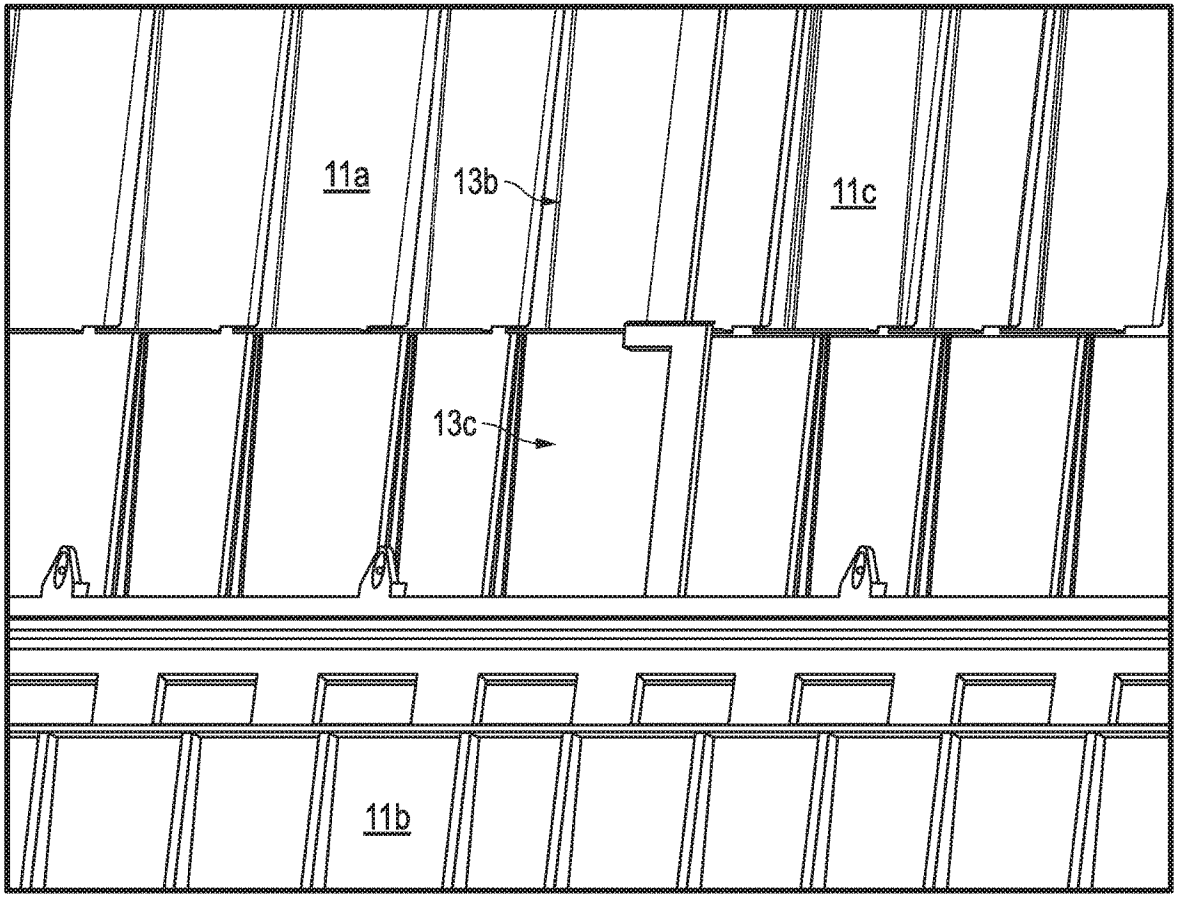
FIG. 5 is an enlarged rear isometric view of an engagement of an embodiment of three siding products.

Embodiments of the panel 11 may further include a butt leg 31. As shown in FIGS. 4 and 5, the butt leg 31 may extend rearward from back BA and upward from adjacent the bottom BO of the panel 11. Such a configuration of butt leg 31 may comprise a male extension. In an embodiment, the butt leg 31 of an upper panel 11*a* may be configured to couple with and engage the hanger clip 21 of a lower panel 11*b* in two courses of panels 11*a* and 11*b*. A panel 11*c* also is shown in FIG. 5, in the same course as panel 11*a*. The butt leg 31 and the hanger clip 21 can be substantially parallel to each other and the front F of the panels 21. The butt leg 31 and hanger clip 31 can be skew to each other and/or to the front F of the panels 21. In one version, the hanger clip 21 of the lower panel 11*b* and the butt leg 31 of the upper panel 11*a* directly engage each other without the need of an additional component. For example, U.S. Pat. No. 8,407,962 requires an additional "u-shaped member" (i.e., a third component) to complete the union between two of its panels.

In some embodiments, the butt leg 31 of the upper panel 11*a* may be configured to engage the hanger clip 21 of a lower panel 11*b* without interlocking, such that they do not engage each other with positive snap action engagement. In contrast, U.S. Pat. No. 7,980,037 requires both interlocking and positive snap engagement. In other embodiments, the hanger clip 21 of the lower panel 11*b* and the butt leg 31 of the upper panel 11 may be configured to only engage each other with friction. In some versions, the panel 11 does not have an aperture adjacent the hanger clip 21 that is configured to receive a lip edge 33 (FIG. 4) of the butt leg 31.

As described herein, the hanger clip 21 may include a forward extension 25 and a downward extension 27 extending from the forward extension 25. The downward extension 27 may comprise interface protrusions 29 on an interior, rearward facing surface thereof. The interface protrusions 29 may provide an interference fit between hanger clip 21 and butt leg 31. In some examples, the interface protrusions 29 may comprise hemispherical or cylindrical dimples. In other examples, the interface protrusions 29 may comprise elongated ribs.

As shown in FIGS. 1-3, embodiments of the panel 11 may further include a plurality of hammer positioning pads (HPP) 41. The HPP 41 may extend from the panel 11 and may be spaced apart from the hanger clip 21. Versions of the HPP 41 do not contact the hanger clip 21. The HPP 41 may be configured to be horizontally impacted (i.e., toward side S1 or toward side S2) by a hammer to adjust a position of the panel 11 on a structure from side to side prior to fastening the panel to the structure. The panel 11 may be considered 'self-supporting' on the structure prior to fastening due to the friction and/or interference fit between the hanger clip 21 on an already-installed lower course of panel 11, and the butt leg 31 on an upper course of a non-yet-fastened panel 11.

In an embodiment, the HPP 41 comprise rectangular pads that extend forward from the front F of the panel 11. The HPP 41 may be vertically oriented, as shown. In other versions, the HPP 41 may be horizontally oriented (not shown). The HPP 41 can be substantially perpendicular to the front F of the panel 11. In an example, the HPP comprise at least about 4 HPP and not greater than about 20 HPP. In another example, the HPP 41 may comprise about 0.25 HPP per foot of length L of the panel 11, to about 2 HPP per foot of length L of the panel 11.

Embodiments of the HPP 41 may comprise grouped pairs of adjacent HPP 41, as shown in FIG. 3. In a version, the HPP 41 in a grouped pair of HPP 41 may be spaced apart from each other by at least about 0.25 inches, and not greater than about 2 inches. Each grouped pair of adjacent HPP 41 may be spaced apart from other ones of the grouped pairs of adjacent HPP 41, as shown in FIG. 1. For example, the grouped pairs of HPP 41 may be spaced apart from each other by at least about 4 inches, and not greater than about 12 inches.

Embodiments of the HPP 41 may be located adjacent the top T of the panel 21. In a particular version, the panel 11 can have a plurality of top tabs 53 extending from the top T thereof at an uppermost portion of the panel 11. The HPP 41 can extend forward from the top tabs 53, as shown.

As shown in FIG. 2, a bottom of the HPP 41 can be co-planar with a top of a fastener slot 51 of the panel 11. In another embodiment, the HPP 41 can be displaced or spaced apart longitudinally by a distance 55 (FIG. 3) from an adjacent fastener slot 51 by at least about 0.25 inches.

In some embodiments, the fastener slot 51 can have a fastener plane of reference PF (FIG. 2). The fastener slot 51 may be provided with only one fastener depth stop (FDS) that abuts or is adjacent to the fastener slot 51. The only one fastener depth stop FDS may be located below the fastener slot 51, as shown. The only one fastener depth stop FDS can be an only obstruction to the fastener slot 51, such that the fastener slot 51 is unobstructed above and to the sides thereof. Optionally, a collective overall length of the fastener depth stop FDS may be substantially equal to the length LHC of the hanger clip 21.

In a version, the only one FDS may comprise a stop plane of reference PS that is displaced forward from the fastener plane of reference PF by a distance 57 that is approximately equal to or greater than the thickness of a conventional nail head. For example, the distance 57 can be at least about 0.030 inches, and not greater than about 0.125 inches. In another embodiment, a center of the fastener slot 51 may be spaced apart from the FDS by a distance 59. The distance 59 may be vertical, as shown in FIG. 2, and may comprise about one-half diameter of a fastener head. For example, the distance 59 may comprise at least about 0.25 inches.

Figure 6:
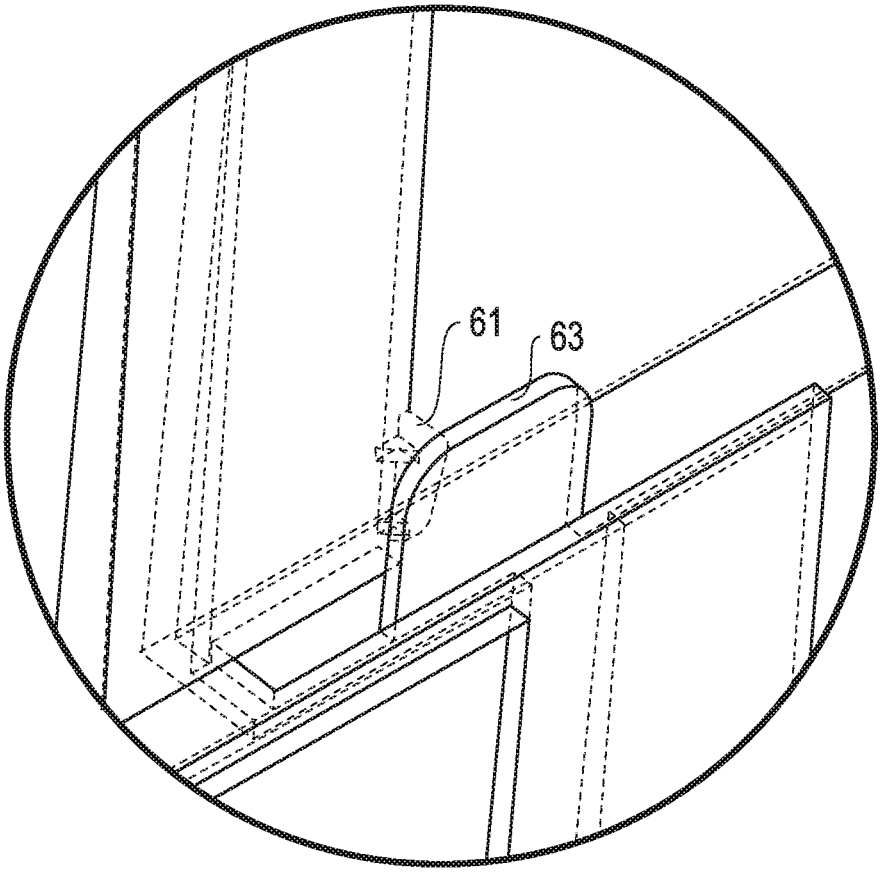
FIG. 6 is a further enlarged, opposite rear isometric view of an engagement of an embodiment of two siding products.

Referring to FIGS. 1 and 6, embodiments of the panel 11 may further include one or more male and female side tabs 61, 63. Tabs 61, 63 would normally appear in FIG. 5, but were removed to simplify the drawing. Each of the male and female side tabs 61, 63 may have a substantially planar orientation. In one version, the male and female side tabs 61, 63 are substantially perpendicular to each other (FIG. 6). In some versions, the male and female side tabs 61, 63 are configured to have an interference fit. In some versions, the interference fit may be configured to permit laterally adjacent panels to be vertically adjusted (i.e., slight vertical movement) relative to each other, rather than horizontally adjusted (i.e., slight horizontal movement) relative to each other. See, e.g., U.S. Pat. No. 7,207,145, which is incorporated herein by reference in its entirety.

As described herein, the panel 11 may comprise three simulated courses 13*a*, 13*b*, 13*c* (FIGS. 1 and 5) of simulated shingles 15. Course 13*a* may be designated as an upper course, course 13*b* may be designated as a center course, and course 13*c* may be designated as a lower course. Embodiments of the panel 11 may include one or more male tabs 61 adjacent one side S1 of one or more of the courses 13*a*, 13*b*, 13*c*. Embodiments of the panel 11 also may include one or more female side tabs 63 adjacent an opposite side S2 of the one or more courses 13*a*, 13*b*, 13*c*.

Figure 7:
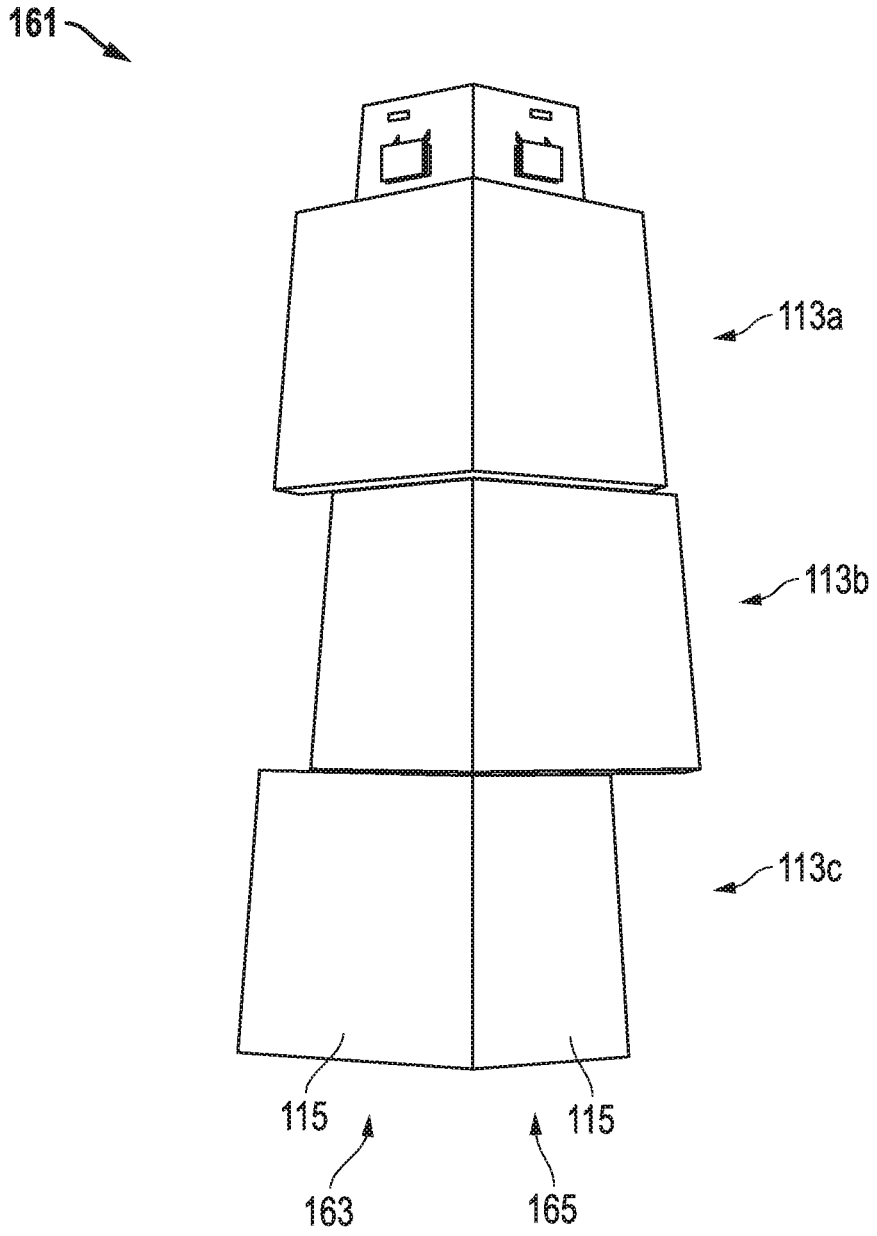
FIG. 7 is a front isometric view of an embodiment of corner siding product.

In still another embodiment (FIG. 7), the panel may comprise a corner panel 161 having substantially perpendicular sections 163, 165 configured to be complementary in shape to a corner of a building. The corner panel 161 may comprise a compound mitre, such that each section 163, 165 of the corner panel 161 is tapered in at least two directions. Like panel 11, panel 161 may comprise three simulated courses 113*a*, 113*b*, 113*c* of simulated shingles 115, as described herein. Embodiments of the corner panel 161 may include offset courses, such as those shown, and/or those depicted in U.S. Pat. No. 6,684,587, which is incorporated herein by reference in its entirety.

Embodiments of the siding product are suitable for weather-protective exterior application in overlapping horizontal courses. The sides and edges of the panels are formed and configured to overlap and interlock with each other, in same and adjacent courses.

Some embodiments of the siding product are not roofing products. For example, the siding product may not be provided with the requisite thickness, strength, impact resistance, roofing code compliance, fire code compliance, etc., to be used as a roofing product. Versions of the siding product are not 'walkable', as is understood in the roofing industry.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A siding product, comprising:

a panel comprising a front with a simulated wood grain, a hollow back opposite the front, a longitudinal length extending in an x-direction, a lateral width extending in a y-direction, and a transverse depth extending in a z-direction, the panel having a hanger clip on the front that has a hanger clip length that extends longitudinally in the x-direction at least 50% of the longitudinal length of the panel a butt leg configured to engage the hanger clip of a lower panel without interlocking, such that they do not engage each other with positive snap action engagement; and at least one hammer positioning pad (HPP) extending from the front of the panel in the z-direction and configured to be impacted in the x-direction to adjust a position of the panel in the x-direction when the butt leg is engaged with the hanger clip of the lower panel.

2. The siding product of claim 1, wherein the hanger clip length is at least 60% of the longitudinal length of the panel.

3. The siding product of claim 2, wherein the hanger clip length is at least 70% of the longitudinal length of the panel.

4. The siding product of claim 3, wherein the hanger clip length is at least 80% of the longitudinal length of the panel.

5. The siding product of claim 4, wherein the hanger clip length is at least 90% of the longitudinal length of the panel.

6. The siding product of claim 5, wherein the hanger clip length is at least 95% of the longitudinal length of the panel.

7. The siding product of claim 1, wherein the hanger clip is continuous.

8. The siding product of claim 7, wherein the hanger clip is a single integrated clip.

9. The siding product of claim 1, wherein the hanger clip includes a plurality of apertures formed therein.

10. The siding product of claim 1, wherein the hanger clip includes a forward extension that extends from a front of the panel and a downward extension that extends downward from the forward extension.

11. The siding product of claim 1, wherein the downward extension forms an angle relative to the front of the panel and the angle is less than 10 degrees.

12. The siding product of claim 11, wherein the angle is not greater than 5 degrees.

13. A siding product, comprising:

a panel having a plurality of simulated courses of simulated shingles including a front, back, top, bottom and sides;

a hanger clip that extends from the front of the panel, wherein the hanger clip is a single continuous clip that extends along at least 50% of the longitudinal length of the panel;

a butt leg that extends from the back of the panel and is configured to engage the hanger clip of a lower panel in two courses of panels; and a fastener slot having a fastener plane of reference, and only one fastener depth stop (FDS) that abuts the fastener slot, the only one FDS comprising a stop plane of reference displaced forward from the fastener plane of reference by at least 0.030 inches, and not greater than 0.125 inches.

14. The siding product of claim 13, wherein the hanger clips includes a forward extension that extends from a front of the panel and a downward extension that extends downward from the forward extension.

15. The siding product of claim 14, wherein the downward extension comprises a plurality of interface protrusions on an interior, rearward facing surface of the downward extension.

16. The siding product of claim 15, wherein the interface protrusions comprise hemispherical dimples.

17. The siding product of claim 15, wherein the interface protrusions comprise elongated ribs.

18. The siding product of claim 13, wherein the butt leg and the hanger clip of the lower panel do not engage each other with positive snap action engagement.

19. The siding product of claim 13, wherein the butt leg and the hanger clip of the lower panel engage each other with friction.

* * * * *